US005628689A

United States Patent [19]

Saint et al.

[11] Patent Number: 5,628,689

[45] Date of Patent: May 13, 1997

[54] LEG SUPPORT STRUCTURE FOR CHILD'S SWING

[75] Inventors: David Saint; James A. Sack, both of Elverson, Pa.

[73] Assignee: Graco Children's Products, Elverson, Pa.

[21] Appl. No.: 556,055

[22] Filed: Nov. 9, 1995

[51] Int. Cl.[6] ..... A63G 9/00

[52] U.S. Cl. ..... 472/118; 472/119

[58] Field of Search ..... 472/118, 119, 472/120, 121, 122, 123, 124, 125; 248/166, 435

[56] References Cited

U.S. PATENT DOCUMENTS 4,256,300 3/1981 Boucher ..... 472/118

4,537,392 8/1985 Defibaugh ..... 248/166

*Primary Examiner*—Kien T. Nguyen

*Attorney, Agent, or Firm*—Morgan, Lewis and Bockius LLP

[57] ABSTRACT

A leg support structure for a foldable child swing that can be maintained in either an open position or a folded position and that is comprised of a housing, a plurality of support legs, and a leg brace for anchoring the legs and securing the legs within the housing in either an open or a folded position. In particular, the leg support structure is able to secure the legs in either the open position wherein the end of the legs are spread apart relative to each other and projected away from the housing or in the folded position wherein the legs are parallel to each other and the end of the legs are proximate and collapsed inwardly toward the housing.

17 Claims, 7 Drawing Sheets

LEG SUPPORT STRUCTURE FOR CHILD'S SWING

BACKGROUND OF THE INVENTION

1. Field of the Invention

The present invention relates to a leg support structure, and more particularly, to a leg support structure that can be used, for example, as part of a child's swing and that can be conveniently folded together when the swing is in storage.

2. Description of the Related Art

A leg support structure typically used with a child's swing employs two sets of legs that can be spread apart when the swing is in use and folded together when the swing is in storage. Known leg support structures that have been used with child swings can be seen, for example, in U.S. Pat. Nos. 4,589,657, 4,452,446, and 4,324,432. Conventional child swings typically include a housing with an attached child swing seat to which four legs (two front legs and two back legs) are installed to support the weight of the device and the child.

During operation of some conventional swings, the legs tend to gradually "walk" together. Specifically, during the back swing of the device, the weight of the child and the child's backward momentum tend to rock the swing backward, thereby tipping weight of the swing and the child onto the back legs while simultaneously lifting the swing's front legs slightly. As the front legs are lifted, they tend to pivot inwardly a small degree due to the force of their own weight until they again make contact with the ground. This slight pivoting motion results in a new leg configuration in which the front and back legs are somewhat closer. This process is repeated by the back legs and then the front legs again as the oscillating motion repeats itself over and over in the same manner as described above. In this fashion, the legs gradually "walk" together.

This walking phenomenon reduces the stability of the swing and can potentially result in the dangerous collapse of the leg structure and the swing. Thus, known leg structures typically include a leg brace that connects front and back leg pairs to prevent them from walking together during use. Before the swing may be stored, the brace must be disadvantageously removed to allow the legs to pivot together.

Another disadvantage of the conventional device is that the legs are typically spread both apart and away from the gear housing to provide maximum stability for the swing. However, when the legs are pivoted into the folded position, they disadvantageously remain spread away from the gear housing from side to side, thereby increasing the necessary space required to store the device. Still another disadvantage of the conventional device is that the swing housing is typically formed from more than one part in order to form the middle and end sections.

SUMMARY OF THE INVENTION

Accordingly, an object of the present invention is to provide support legs for a child's swing that do not require an additional leg brace to prevent the legs from undesirably walking together during use. Another object of the present invention is to provide pivotable support legs that fold into a more compact configuration, that are easy to assemble without the use of tools. In addition, a further object of the present invention is to provide a housing that can be formed from a single molded part.

To achieve these and other advantages and in accordance with the purpose of the invention, as embodied and broadly described, the invention provides for a leg brace for stabilizing a leg within a housing, comprising an upper support for pivotally anchoring the leg such that the leg can move between a folded position and an open position, a lower support having a sliding surface for guiding the leg between the folded position and the open position and having a securing portion for maintaining the leg in the open position, and a main portion connected to the housing and linking the lower support and the upper support.

In another aspect, the invention provides for a child swing with legs that rotate between a folded position and an open position, comprising a housing having an opening and including an inner surface, a plurality of legs, each leg having an intermediate portion and an end portion, and a leg brace mounted in the housing and adjacent to the opening for pivotally anchoring the end portion of each leg and for securing the intermediate portion of each leg in the open position in cooperation with the inner surface of the housing to support the child swing during use or in a folded position to accommodate storage of the child swing.

Yet another aspect of the invention provides for a foldable child swing that can be configured in either an open position or a folded position, comprising a child swing housing, a plurality of legs, each leg having a first end, an intermediate portion, and a second end and a flexible brace for anchoring the first end of the plurality of legs and for securing the intermediate portion of the legs, the flexible brace being able to secure the intermediate portion of the plurality of legs in either the open position wherein the second ends are spread apart relative to each other and projected way from the housing or in the folded position wherein the second ends are proximate and collapsed inwardly toward the housing.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate one embodiment of the invention and together with the written description serve to explain the principles of the invention. In the drawings.

DETAILED DESCRIPTION OF THE PREFERRED EMBODIMENTS

Figure 1:
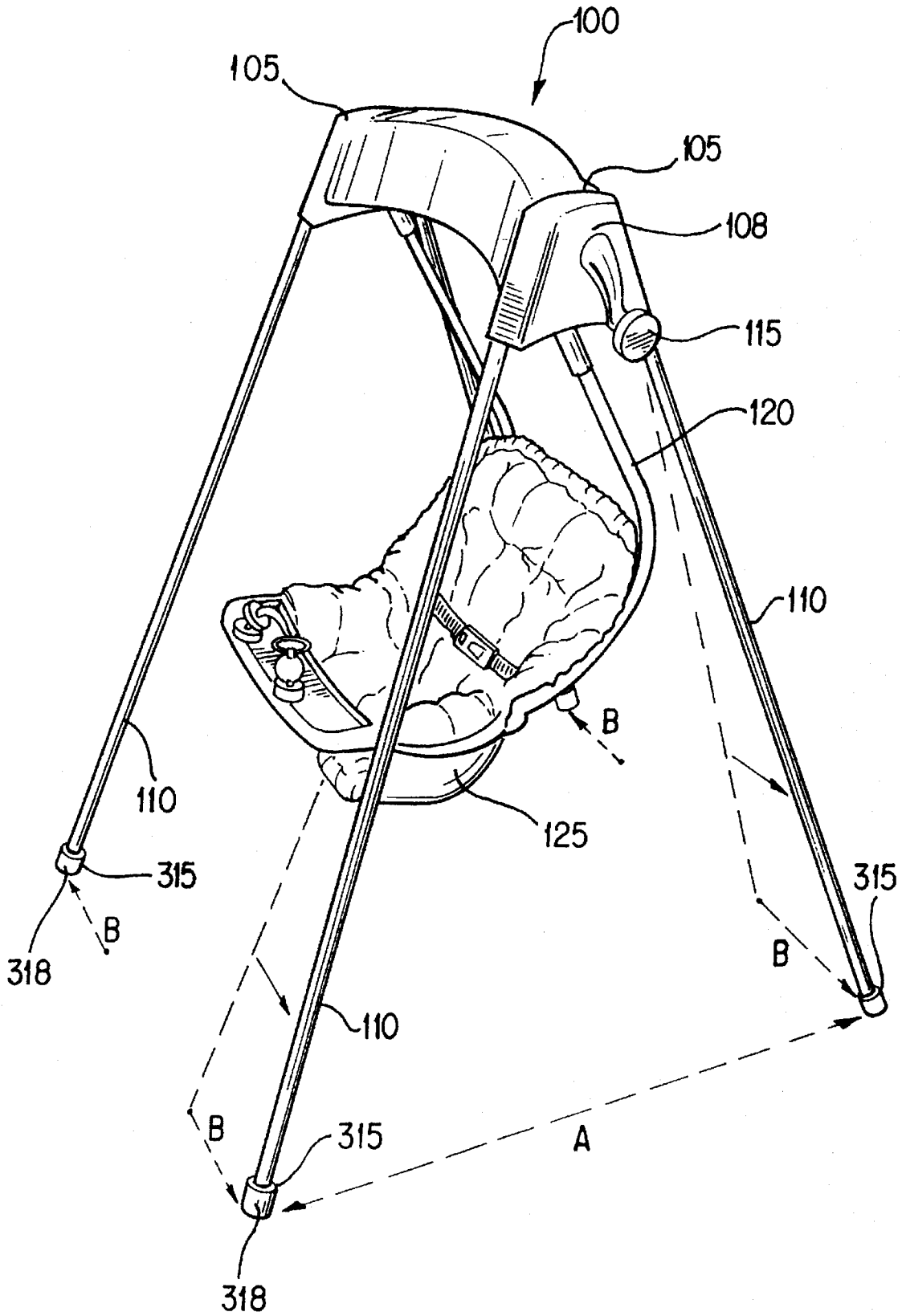
FIG. 1 is a perspective view of the child swing incorporating the leg support structure.

Reference will now be made in detail to the present preferred embodiment of the invention, an example of which is illustrated in the accompanying drawings. As shown in FIG. 1, the preferred embodiment of the present invention is a child swing having a housing 100 that preferably includes two corresponding corner edges 105 that define the ends of the housing. Attached to an end 108 of the housing 100 is a rotatable handle 115 that is attached to a crank (not shown). The crank passes through an opening in the housing to engage a drive mechanism contained therein. The drive mechanism typically includes a main spring having a plurality of coils for storing an input torque. The spring has an escapement end that engages with the interior mechanical drive mechanism and a wind end that engages with handle 115 and its corresponding crank to receive an input torque.

Figure 3:
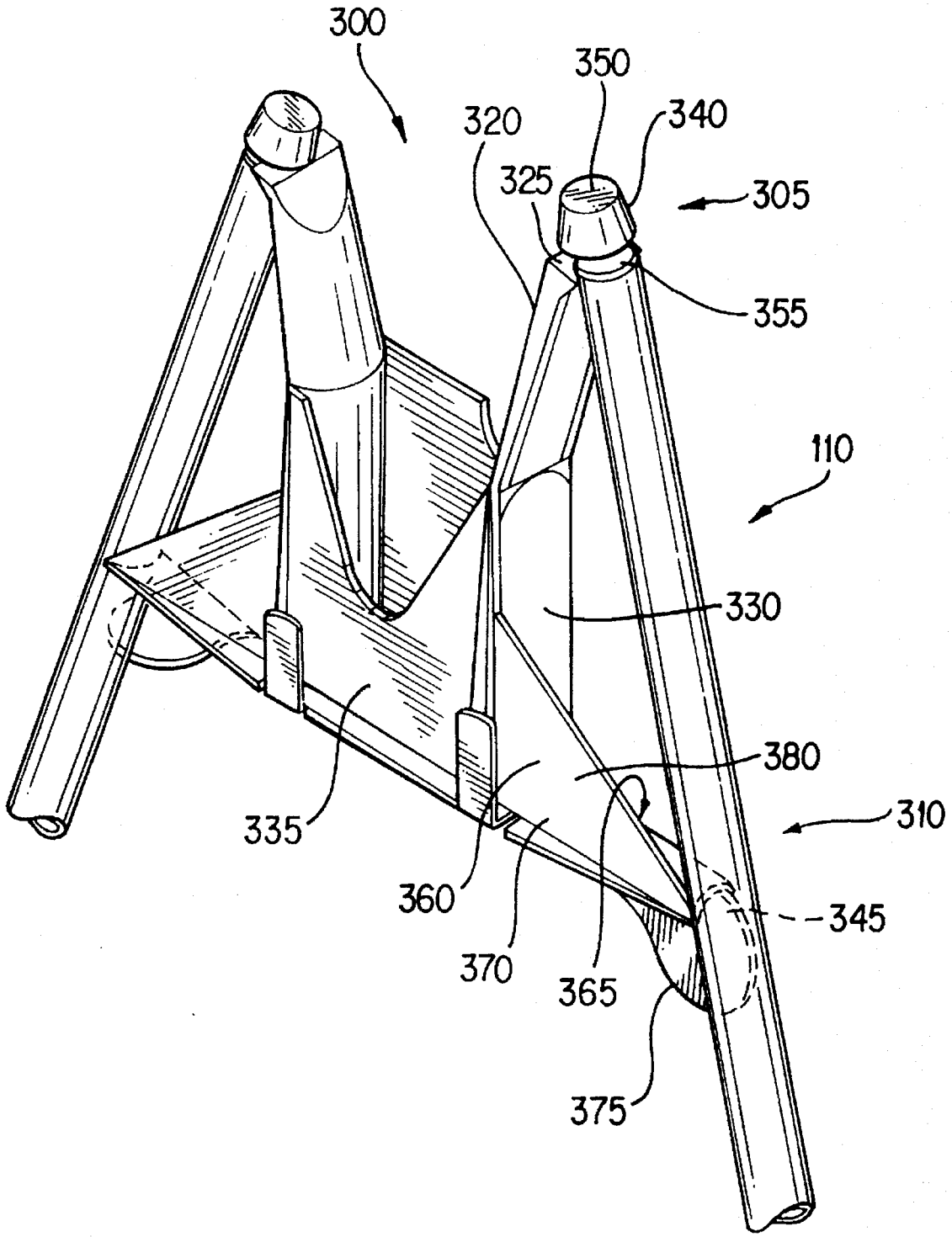
FIG. 3 is a perspective view of the leg brace and legs where the legs are in the open position.

Suspended from the housing 100 are two swing arms 120 that are preferably comprised of tubular metal bars that support a cushioned, cloth covered child seat 125 having a tray and restraining belt to secure the child user. The preferred embodiment further includes two sets of legs 110 also comprised of tubular metal bars, each set having a front leg and a back leg (not individually numbered). Each leg includes a first section 305 and an intermediate section 310 that are contained in housing 100, (as further shown in FIGS. 3 and 4), and a second section 315 that contacts with the ground. The second section may also include an end cap 318 made of a non-slip material such as rubber or plastic to prevent the legs from slipping on the ground.

As shown in FIG. 1, when the legs are in the open position, they extend apart from each other (as indicated by Arrow A) and away from the pivot housing (as indicated by Arrow B) to better stabilize the device and prevent the swing from tipping over in response to the rocking motion of the child seat. The wider base increases the required force that must be generated to tip the swing forward or backward sufficiently to cause the swing to fall over. The shape of the side 108 of the swing housing 100 is somewhat triangular to provide a continuous, smooth support surface within the housing that prevents the leg 110 from spreading beyond the preferred distance A to assure that the child seat 125 will remain a proper distance above the ground.

Figure 2A:
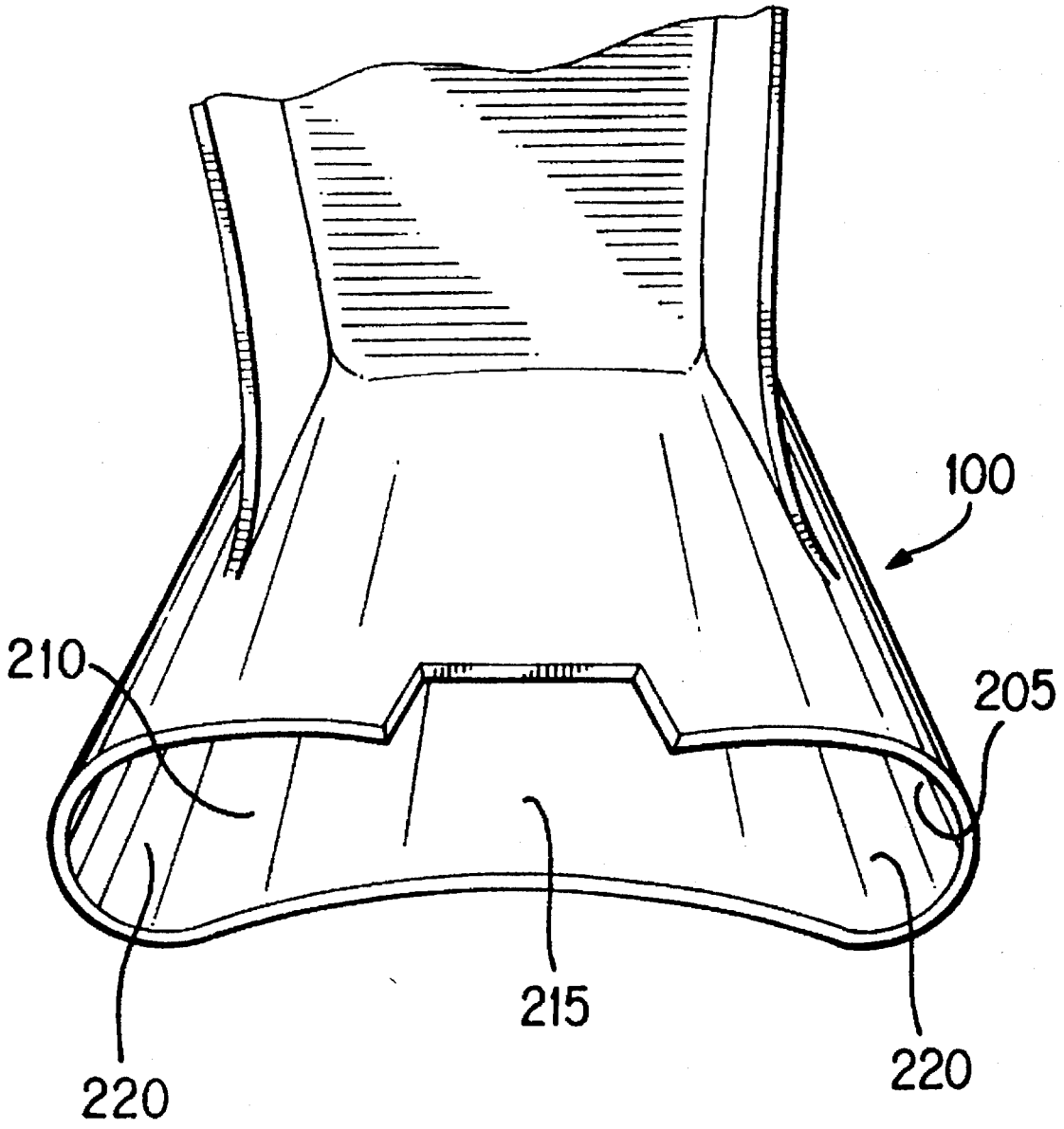
FIG. 2A is a bottom view of the child swing housing.

As shown in FIG. 2A, housing 100 is a generally hollow structure that includes an opening 210 for the legs 110, where the opening 210 includes an inner surface 205. Opening 210 preferably includes a wider central portion 215 and narrower end portions 220. See FIG. 2C. The narrower end portions 220 partially define the position of the legs when the device is in an open position while, as shall be described in greater detail below, the wider central portion 215 partially defines the position of the legs when the device is in the folded position.

Figure 2B:
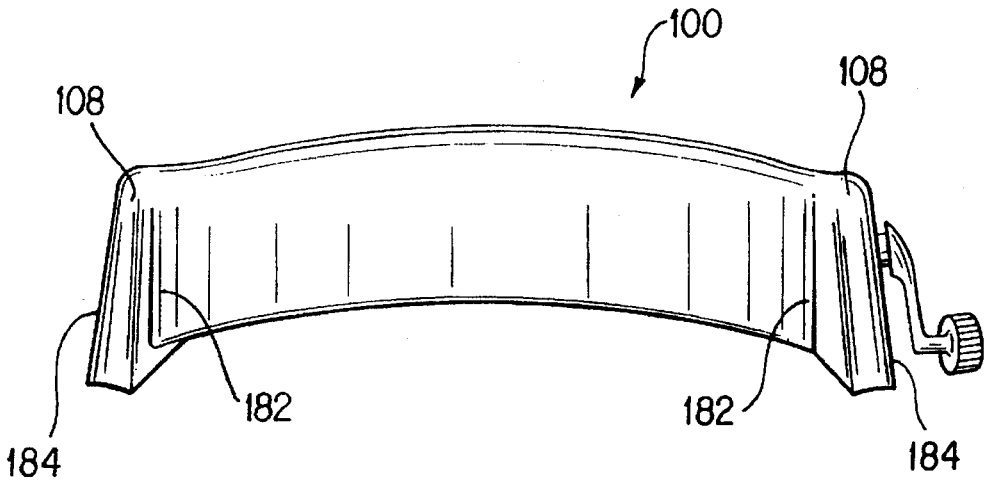
FIG. 2B is a front side view of the child swing housing.

As shown in FIG. 2B, housing 100 has a side 108 having an inner edge 182 and an outer edge 184. Inner edge 182 is vertical while outer edge 184 is inclined. When viewed from the front, this configuration allows the legs to rest in the vertical position when folded and in an inclined position when opened. In addition, this configuration strengthens the housing structure. This structure also allows the housing to be formed from a single molded part. Specifically, the wider opening and shape of the inner edge and outer edge allow for the preferred structure to be formed in a single molding operation. This significantly simplifies production and reduces the cost of manufacture.

Figure 2C:
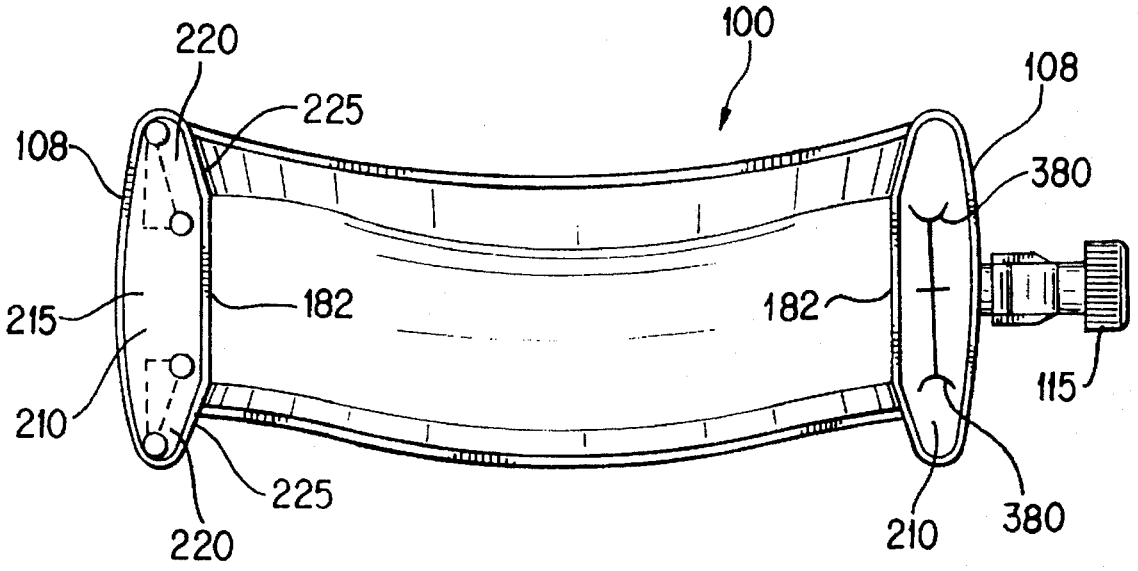
FIG. 2C is a bottom view of the child swing housing showing the interior of the housing with the bottom cover removed.

FIGS. 2A and 2C show that opening 215 is formed in a rounded fashion at each end to better engage with the cylindrical legs 110. The housing 100 may be formed from a sturdy, rigid plastic material sufficient to support the weight of the interior drive mechanism, the child seat 125 and the child. In addition, the housing should be made of a material that is sufficiently sturdy to withstand the force applied by the weight of the device and its user both at a point located at the top of the housing and along inner surface 205 where the force of the spread legs pushes against the housing's interior.

FIG. 2C shows the interior of housing 100 and further discloses the diagonal path legs 110 travel as they pivot between the open and closed position. Mounted within housing 100 are ribs 380 which are preferably concave in shape. Ribs 380 engage with and pivotably anchor leg 110. See FIG. 3.

Mounted in housing 100 is leg brace 300 that operates in combination with legs 110. Leg brace 300 is shown with the legs 110 in an open position in FIG. 3, and includes a main body 335, which may be hollow, and four flexible projecting members that will be described in further detail below. Leg brace 300 is preferably formed from a material that is partially flexible to allow for assembly of the device and is shaped to withstand compressive loading to prevent the device from flexing under the anticipated stress that will be encountered during normal use.

Projecting from main section 335 are two upper support members 320 each having a contact portion 325. Contact portion 325 of upper support 320 engages with and pivotally anchors legs 110 at a first section 305. In the preferred embodiment, the first section 305 includes a smooth ball-shaped portion 340 having a groove 355 to anchor the leg 110 in a rotatable "ball and socket" fashion. The smooth ball-shaped portion 340 has a hole 350 in it to make the ball shape easier to manufacture. Also, the upper support members 320 may be curved in shape (resembling a celery stalk) thereby having a cross-section that is crescent-shaped to increase the threshold amount of force necessary to flex the upper support member 320. As discussed above, the upper support member 320 must not be too flexible. Because the upper support member has a crescent-shaped cross-section, its bending moment across the horizontal axis is increased, thereby increasing the support member's structural integrity and decreasing its flexibility. In this way, the upper support member's flexibility can be increased without having to employ heavier, and /or more expensive, construction materials.

Contact portion 325, which is located at an end of upper support member 320, may be concave in shape to form a beveled edge between itself and groove 355 and thus increase the surface area portion which contacts section 305 to create a better engagement and anchoring of leg 110. Leg 110 is prevented from rotating into a folded position by securing portion 345, which contacts with and secures the intermediate portion 310 of leg 110 so that leg 110 cannot slide inwardly toward main portion 335. Securing portion 345 thus prevents the legs from walking together during oscillation of the swing.

Figure 4:
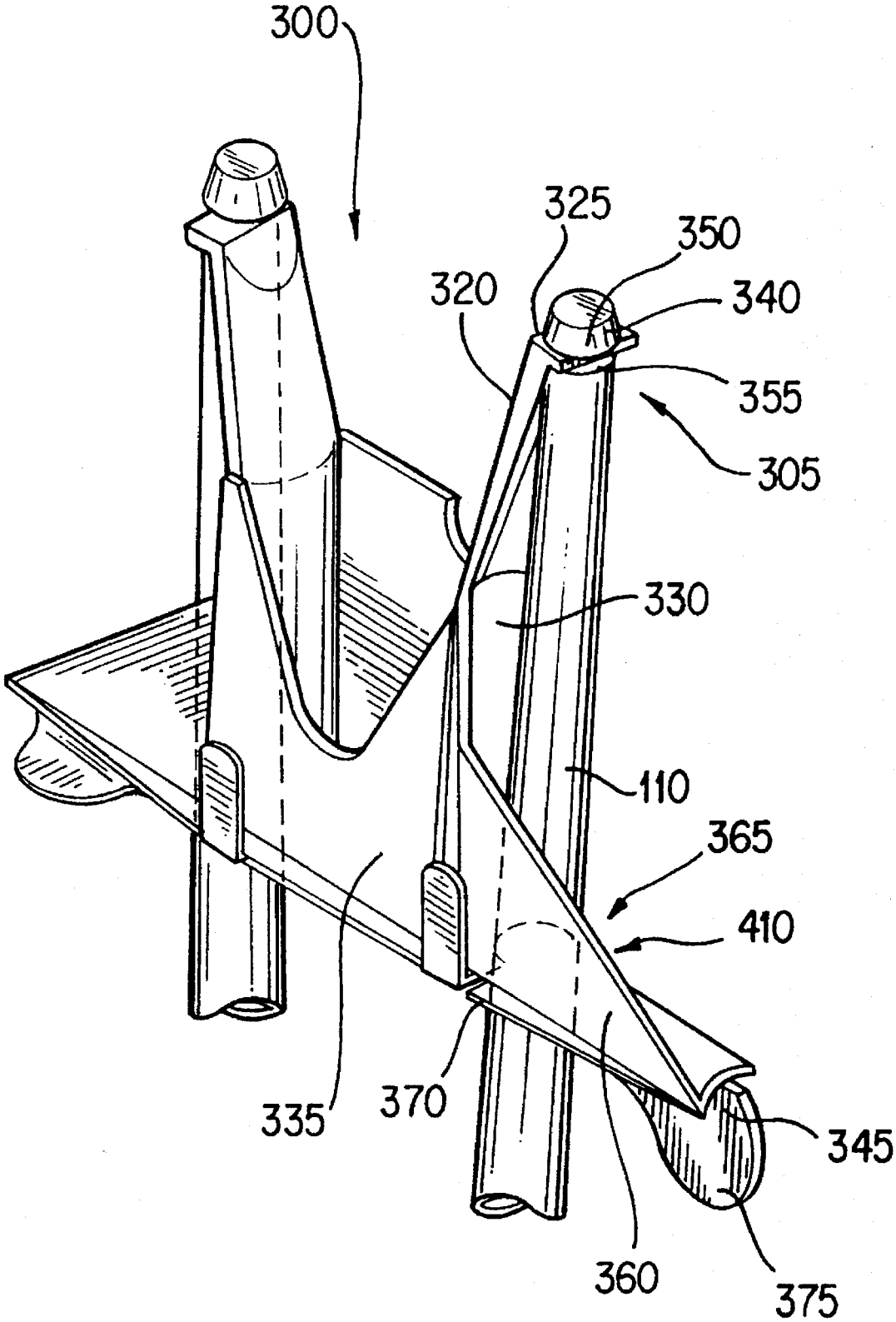
FIG. 4 is a perspective view of the leg brace and legs where the legs are in the folded position.

FIG. 4 shows the leg brace 300 with the legs 110 in the folded position. Again, leg brace 300 has upper support members 320, each with a contact portion 325 that pivotally anchors the first section 305 of leg 110. When in the folded position, legs 110 rest against side portions 330 of main portion 335 in a parallel position thereby bringing second section 315 of legs 110 closer together. Accordingly, side portions 330 are preferably concave to better receive legs 110 which are preferably cylindrical in shape.

Figure 5:
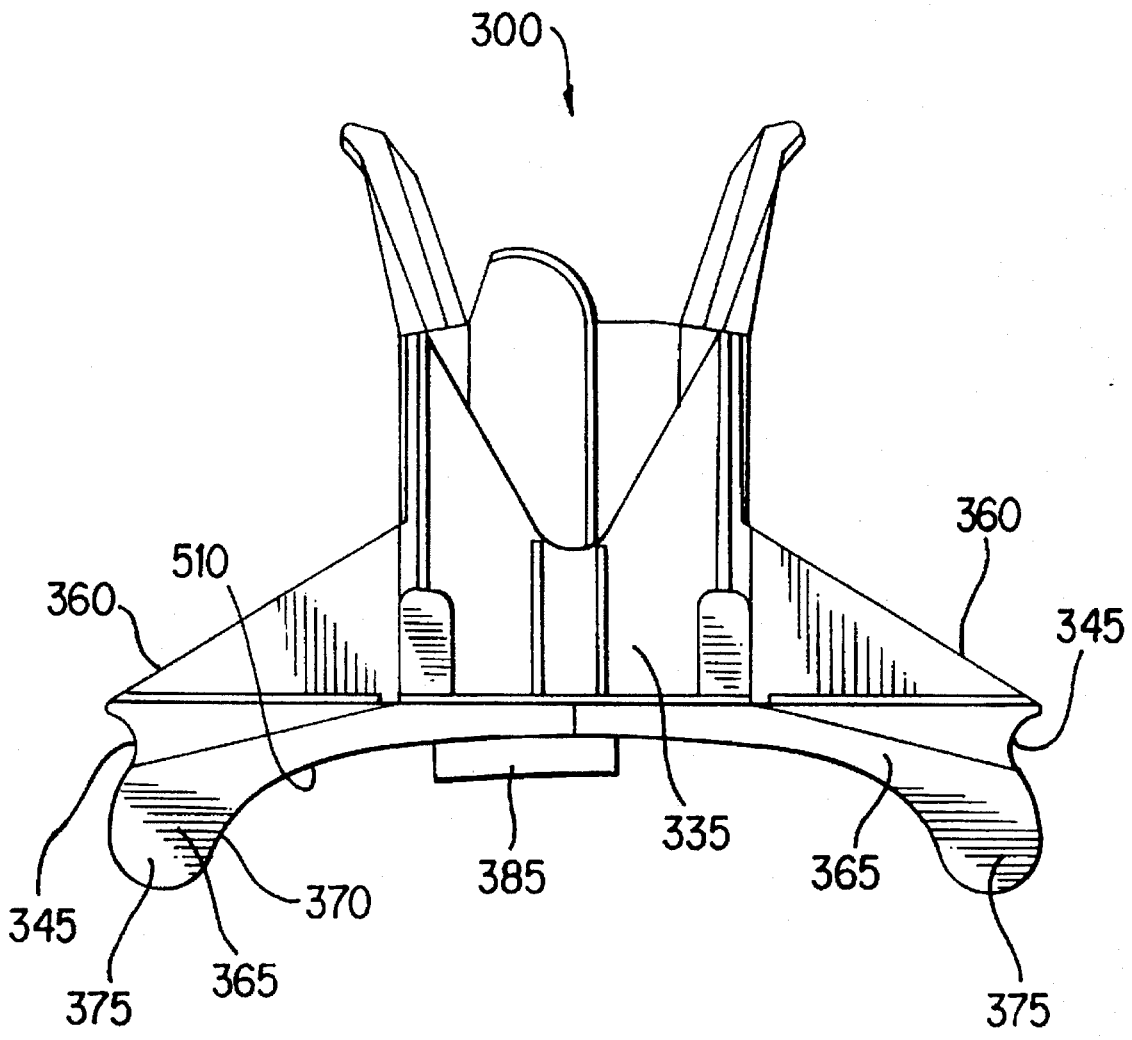
FIG. 5 is an end view of the leg brace.

FIG. 5 shows an end view of the leg brace 300. Leg 110 pivots in a plane parallel to edge 225 shown in FIG. 2C thus effectively moving in two directions that are perpendicular to each other when leg 110 translates between the open and folded positions. During opening, leg 110 pivots longitudinally along a smooth, sliding surface 510 of a first side 365 of leg brace 300. See FIG. 5. The range of motion of leg 110 is also controlled by the inner surface 205 of housing opening 210. As leg 110 travels diagonally along sliding surface 510, it encounters a tab 375 and, in a cam-like fashion, flexes tab 375 and lower support member 360 away from inner edge 182, allowing leg 110 to travel to the open position. Tab 375 and lower support member 360 then snap back capturing leg section 310 in concave securing portion 345. Leg 110 is then secured in an open position.

In the reverse operation, tab 375 must be depressed outwardly removing securing portion 345 so that leg section 310 can travel diagonally and inwardly to its folded position against side portion 330 of main portion 335 thereby achieving a more compact configuration when the swing is in storage.

The diagonal pivoting motion allows legs 110 to spread apart from each other and away from the housing 100 to provide a more stable base for the device. Similarly, when the swing is not in use, the diagonal pivoting motion of the present invention allows the legs 110 to fold together and inwardly to form a compact configuration.

Figure 2D:
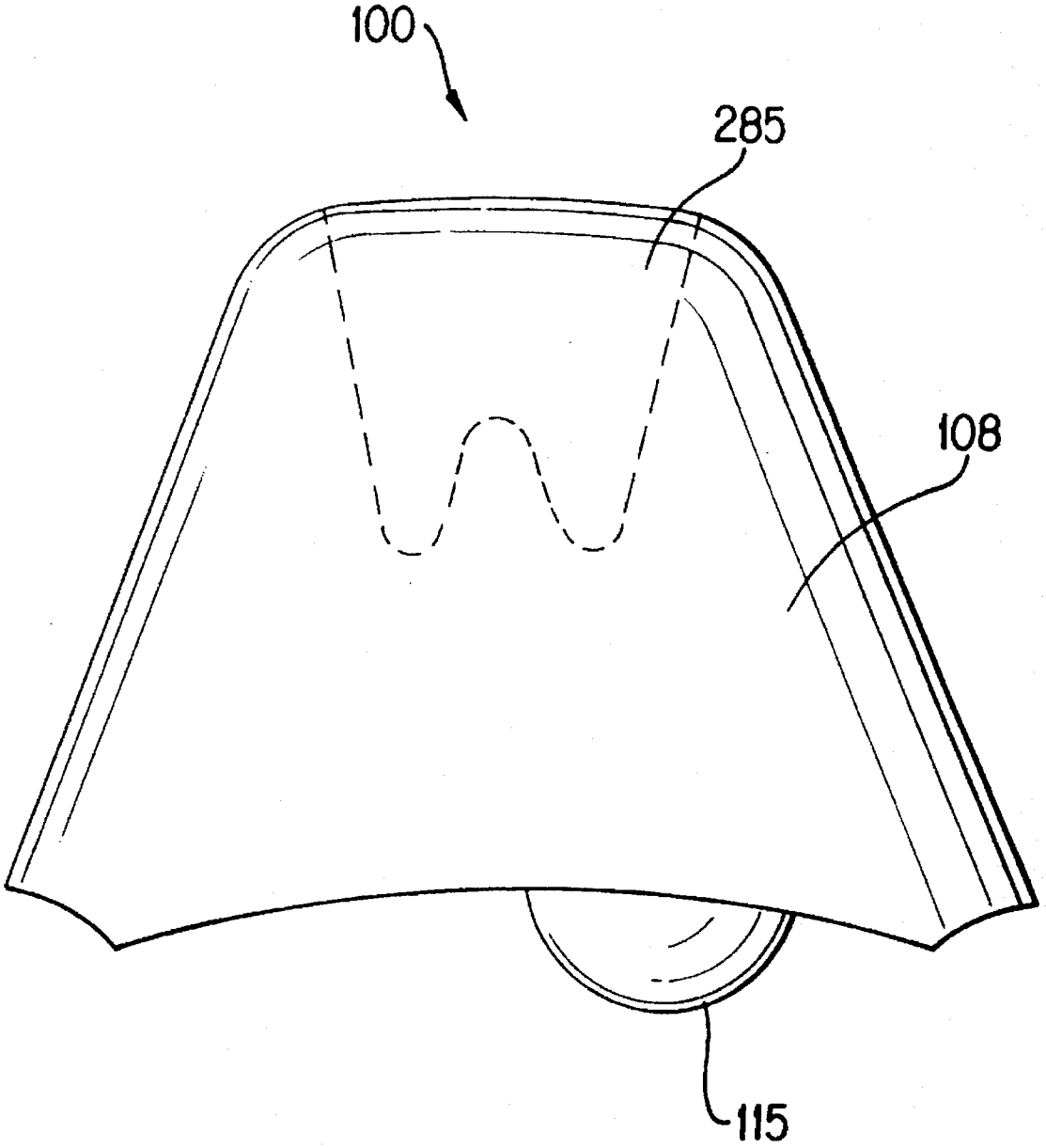
FIG. 2D is a side view of the child swing housing showing hidden flex limiting device.

Although not shown, leg brace 300 is preferably mounted within housing 100 adjacent to short end 108. To assemble the invention, legs 110 are inserted into opening 210 in housing 100 such that they engage with the upper support members 320 of leg brace 300. In the preferred embodiment, the first section 305 of leg 110 includes a ball-shaped portion 340 which engages with the contact portion 325 in a cam-like fashion. Because upper support members 320 are somewhat flexible, the cam-like action causes the upper support member 320 to flex as the first section 305 becomes fully inserted into housing 100. The upper support member 320 will then snap back to engage the first section 305. In particular, contact portion 325 will engage with groove 355 to pivotally anchor leg 110. In this way, the present invention allows for easy assembly which can be performed without the use of tools. In addition, the housing includes a flex limiting device 285 to prevent upper support member 320 from flexing so far as to break. Set FIG. 2D.

To disassemble legs 110 from housing 100, the legs must first be placed in the folded position so that they are approximately parallel to each other. The ribs 380 and contact portion 325 of upper support member 320 are biased so that they only partially engage groove 355 when legs 110 are in the folded position. In this way, legs 110 will remain anchored to housing 100, but can be removed if pulled away from the housing. The bias of ribs 380 and contact portion 325 are such that they fully engage groove 355 when legs 110 are in the open position. Thus, legs 110 will remain anchored when the legs are open and the swing is in use.

As discussed above, leg brace 300 also includes a pair of lower support members 360 extending from main portion 335 which are flexible and include a tab 375 with a first side 365 and a second side 370. Located on first side 365 is sliding surface 510. Located on second side 370 is securing portion 345, which is preferably comprised of a concave shape, and tab 375 which is a circular member that protrudes outwardly and away from lower support 360.

In the preferred embodiment, legs 110 remain locked in the open position as a result of being secured between securing portion 345 and inner surface 205 of housing 100. To fold legs 110, a force is applied to tab 375 thereby causing lower support members 360 to flex slightly to provide leg 110 with space to maneuver between securing portion 345 and inner surface 205. As discussed above, leg 110 then rotates diagonally from second side 370 to first side 365 of tab 375, and toward side portion 330. Once folded, leg 110 remains in the closed position defined by inner surface 205 and side portion 330.

Legs 110 can be returned to the open position by first sliding legs 110 along sliding surface 510. Next, lower support member 360 is flexed by the cam-like action of outwardly moving legs 110 until securing portion 345 snaps into a holding position. Leg 110 is then secured between inner surface 205 of housing 100 and securing portion 345. This secured position prevents legs 110 from walking together when the swing is in use and eliminates the need for an additional leg bracket.

It will be apparent to those skilled in the art that various modifications and variations can be made in the pivoting leg support structure of the present invention without departing from the spirit or scope of the invention. Thus, it is intended that the present invention cover the modifications and variations of this invention provided they come within the scope of the appended claims and their equivalents.

What is claimed is:

1. A leg brace for stabilizing a leg within a housing, comprising:

an upper support for pivotally anchoring the leg such that the leg can move between a folded position and an open position;

a lower support having a sliding surface for guiding the leg between the folded position and the open position and having a securing portion for maintaining the leg in the open position; and a main portion linking the lower support and the upper support.

2. The leg brace according to claim 1, wherein the upper support includes a contact portion for receiving and anchoring the leg.

3. The leg brace according to claim 1, wherein the securing portion is comprised of a substantially concave section for receiving the leg in the open position.

4. The leg brace according to claim 1, wherein the main portion includes a side member for receiving the leg in the closed position.

5. The leg brace according to claim 1, wherein the sliding surface is located on a first side of a tab included in the lower support.

6. The leg brace according to claim 1, wherein the securing portion is located on a second side of a tab included in the lower support.

7. The leg brace according to claim 1, wherein the upper support and lower support are flexibly movable.

8. The leg brace according to claim 1, wherein the lower support includes a tab for receiving a flexing force to move the lower support and allow the leg to rotate between the open position and the folded position.

9. A child swing with legs that rotate between a folded position and an open position, comprising:

a housing having an opening and including an inner surface;

a plurality of legs, each leg having an intermediate portion and an end portion; and a leg brace mounted in the housing and adjacent to the opening for pivotally anchoring the end portion of each leg and for securing the intermediate portion of each leg in the open position in cooperation with the inner surface of the housing while the child swing is in use.

10. The child swing according to claim 9, wherein the end portion of the leg includes a substantially ball-shaped portion.

11. The child swing according to claim 10, wherein the substantially ball-shaped portion flexes the leg brace to allow the leg to become anchored when the leg is biased against the leg brace.

12. The child swing according to claim 10, wherein the leg brace has a concave contact portion for engaging with and anchoring the substantially ball-shaped portion of the leg.

13. The child swing of claim 9, wherein the leg brace includes a main portion connected to the housing, a lower support connected to the main portion for guiding the leg between the folded position and the open position, and a securing portion connected to the lower support for bracing the leg in the open position.

14. The child swing according to claim 13, wherein the main portion, the lower support, and the interior surface of the swing housing are adapted to secure the intermediate portion of the leg when the leg is in the folded position.

15. A foldable child swing that can be configured in either an open position or a folded position, comprising:

a child swing housing;

a plurality of legs, each leg having a first end, an intermediate portion, and a second end; and a flexible brace mounted within the housing for anchoring the first end of the plurality of legs within the housing and for securing the intermediate portion of the legs, the flexible brace being able to secure the intermediate portion of the plurality of legs in either the open position wherein the second ends are spread apart relative to each other and projected away from the housing or in the folded position wherein the second ends are proximate and collapsed inwardly toward the housing.

16. The foldable child swing according to claim 15, wherein the flexible brace comprises:

an upper support for pivotally anchoring at least one of the legs such that the leg can move between the folded position and the open position;

a lower support having a sliding surface for guiding at least one of the legs between the folded position and the open position and having a securing portion for maintaining the leg in the open position; and a main portion linking the lower support and the upper support.

17. The foldable child swing according to claim 15, wherein:

the housing has an opening and includes an inner surface; and the flexible brace is mounted in the housing adjacent to the opening for pivotally anchoring the first end of each leg and for securing the intermediate portion of each leg in the open position in cooperation with the inner surface of the housing while the child swing is in use.

* * * * *